United States Patent [19]

Gregory et al.

[11] 4,454,730

[45] Jun. 19, 1984

[54] INTERRUPTER APPARATUS FOR HOSIERY KNITTING MACHINE

[75] Inventors: Clifton Gregory, Hickory; Lester W. Campbell, Claremont, both of N.C.

[73] Assignee: Marvel Specialty Company, Hickory, N.C.

[21] Appl. No.: 293,292

[22] Filed: Aug. 17, 1981

[51] Int. Cl.³ ..... D04B 15/92; D04B 15/88; D04B 35/10

[52] U.S. Cl. ..... 66/149 S; 66/147; 66/166

[58] Field of Search ..... 66/147, 149 S, 157, 66/166

[56] References Cited

U.S. PATENT DOCUMENTS

| | | | |
|---|---|---|---|
| 2,625,026 | 1/1953 | Lawson | 66/157 |
| 3,323,334 | 6/1967 | Richards et al. | 66/166 |
| 3,455,124 | 7/1969 | Rossler | 66/147 |
| 4,116,021 | 9/1978 | Harrill | 66/149 S |
| 4,250,723 | 2/1981 | Harrill | 66/147 |

FOREIGN PATENT DOCUMENTS

| | | | |
|---|---|---|---|
| 2249911 | 5/1973 | Fed. Rep. of Germany | 66/149 S |
| 680855 | 1/1965 | Italy | 66/149 S |
| 46-8478 | 3/1971 | Japan | 66/147 |
| 1172294 | 11/1969 | United Kingdom | 66/147 |

OTHER PUBLICATIONS

*The Hosiery Trade Journal*, Sep., 1963, pp. 158, 159.

*Primary Examiner*—Wm. Carter Reynolds
*Attorney, Agent, or Firm*—King and Liles

[57] ABSTRACT

A hosiery handling apparatus for separating individual hosiery articles from a continuous tubular hosiery string and thereafter transporting the separated articles to a remote location includes a control circuit for interrupting operation in the event of a malfunction in the separation of the hosiery string. The control circuit preferably includes an advance switch for detecting passage of a separated article to the remote location and a stop action switch connected in series with the advance switch and responsive to movement of the separating assembly. When a separated article fails to be transported to the remote location, the control circuit terminates operation of the machine.

9 Claims, 7 Drawing Figures

10
35
37
57
112
29
T
S2
25
27
33
W
S1
TO UPPER VENTURI DEVICE
58a
45
58
TO ADVANCE SWITCH RESET DEVICE
C1
59
VOLTAGE SOURCE
61
TO LOWER VENTURI DEVICE
67
60
AIR VALVE
90
AIR PULSE DEVICE
0 61
61a
A
AIR SOURCE

S1
T
81
83
TO KNITTING HEAD, CYLINDERS & OTHER COMPONENTS
C2
M2
112
50
85
M1
MACHINE CONTROL 91
84
101
23
130
116
115
STOP CONTROL
RESET
33
117
120
110
113
VOLTAGE SOURCE
121
122

INTERRUPTER APPARATUS FOR HOSIERY KNITTING MACHINE

TECHNICAL FIELD

The invention relates to hosiery handling apparatus and, more particularly to apparatus for interrupting a knitting machine in the event of a malfunction in the separation of continuously knitted tubular hose.

BACKGROUND ART

Hosiery for many years has been knitted as a string of continuous tubular fabric on Komet machines manufactured by Scott & Williams, Incorporated, New York, N.Y. These machines have become standard in the industry for knitting a wide range of hosiery for men, women and children. The individual articles of hose are connected by a ring of alginate or PVA (polyvinyl acetate) yarn which provides a breakaway connection between the hose.

To further process the hosiery, a "knitter" must periodically remove the string of hose from the storage cannister on the machine. The "knitter" then separates the hose by tearing the alignate yarn ring. This operation presents the individual hose in an inverted condition. In some installations it is desirable to first turn the hose before separating. This can be done by hand, but it will be appreciated that manual separation and handling of hosiery is a wasteful and uneconomical process. Various attempts over the years have been made to provide greater efficiency for handling the hose coming from the Komet knitting machine. A typical "on machine" operation that has been accomplished is disclosed in U.S. Pat. No. 4,116,021, entitled Hosiery Handling Apparatus and Method, and assigned to the assignee of the present invention. This machinery provides a combined process. Each in line hose is inverted into a vertically suspended tube and then jerked away from the string, thereby breaking the alginate ring.

Still another approach has been a "tensionless" separating apparatus as described in U.S. Pat No. 4,250,723 entitled Apparatus for Separating Hosiery and also assigned to the assignee of the present invention. The gripping and separating arm and a clamping arm include a pair of jaws attached to the ends thereof for releasably engaging the knitted tubular fabric as it comes from the knitting head of the machine. The gripping jaws and the clamping jaws intermittently engage the tubular fabric adjacent the weakened portion of the articles and the gripping arm exerts an upward pulling force moving away from the clamping arm to cause the articles to be separated along the weakened portions.

Associated with the handling and separation of the tubular fabric is the stopping of the knitting machine in the event of a malfunction. Heretofore this has been accomplished by complicated mechanisms which are actuated by the traveling hose articles to trip a circuit stopping the machine as described, for example, by U.S. Pat. Nos. 2,625,026 and 3,323,334. These devices are not satisfactory from the standpoint of reliability and simplicity of design.

DISCLOSURE OF THE INVENTION

It is therefore a principal object of the present invention to improve the handling of articles of hosiery produced in a knitting machine and the control of the machine.

Another object of the present invention is to enable interruption of a knitting machine in the event that there is a malfunction in the handling of articles of hosiery formed in a continuous string and separated therein.

It is another object of the present invention to provide a method and apparatus for stopping a knitting machine in the event that an article of hosiery fails to separate and properly advance along a transfer path.

It is a further object of the present invention to provide a system for stopping a knitting machine in the event of a malfunction in the separation of hosiery articles in a manner simpler and more reliable than that used heretofore.

The above objects, as well as others, are accomplished, generally speaking, by an interrupter control circuit including a stop action switch operative to detect the approaching end of the separation cycle for articles of hosiery, and an advance switch operative to indicate if a separated article of hosiery is properly advanced along a hosiery transfer tube. If an article of hosiery is not separated and properly advanced along the tube, the circuit is completed and an acknowledgment signal supplied to the machine control to stop the knitting machine.

The switches are continuously resettable to sense the required conditions necessary for providing the stop control signal. The hosiery advance switch detecting the passage of the articles during transfer along the tube is actuated by a pivotal mechanism including flexible finger means disposed in the path of the articles. The pivotal mechanism is reset by a pneumatic plunger and the advance switch remains in the normally closed position to effect the desired stop action unless an article of hosiery contacts the pivotal mechanism and actuates the switch into the open position.

More precisely in broad terms, the interrupter control circuit includes the stop action switch, advance switch means along the transfer path and the stop control means responsive to the actuation of the switches for actually stopping the machine. The stop action switch is responsive to the movement of the separator arm moving between a first operative position where the first in-line hose is just separated to a second operative position where the arm is in readiness for the next hose to be separated. The advance switch is advantageously positioned directly in the transfer path and is designed to be actuated only in response to a passing article.

Preferably, the advance switch means includes a micro switch and a pivotal actuator arm for the micro switch. A detent means is provided for positioning the arm in a tripped position when engaged by the article and a reset position. The reset means of the invention is operative to reclose the advance switch before each cycle of the machine.

The transfer tube defines the transfer path for the articles. The flexible fingers are preferably spring wire attached to the end of the actuator arm and having sufficient resiliency to trip the arm but also to allow certain passage of the article.

Preferably, the separator means includes a pivotal separator arm and moving means for the arm including a pneumatic cylinder responsive to the machine control for the knitting machine. Gripper jaws are provided on the arm to grasp the string to effect the separation upon movement of the separator arm. A second pneumatic cylinder is provided for actuating the gripper jaws in response to the machine control. A stationary gripping arm with gripping jaws, also operated by the machine control is also provided.

A novel combined pneumatic transport and reset control circuit is provided. An air valve responsive to the separation cycle switch activitates a venturi device in the transfer tube for providing suction along the tube. The same valve activates an air pulse device to actuate the plunger of the actuator arm reset means.

The stop action and the advance switch means are preferably in series with a voltage source. The advance switch is normally closed, as mentioned above, and the stop action switch is normally open. If a hosiery article is not properly separated and transferred along a transfer path, the advance switch remains in the closed position and as soon as the stop action switch is closed, the interrupter control circuit is made. An acknowledgment signal is sent from the stop control to the machine control, the machine is interrupted and potential damage to the machine is prevented. The stop action switch is positioned for actuation before actuation of the separation cycle switch so that the machine is assured to be interrupted before the next separation cycle can be initiated.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The foregoing and other objects, features and advantages of the invention will also become more readily apparent upon reference to the following detailed description of the best mode for carrying out the invention, when taken in conjunction with the accompanying drawings, in which.

BEST MODE FOR CARRYING OUT THE INVENTION

Figure 1:
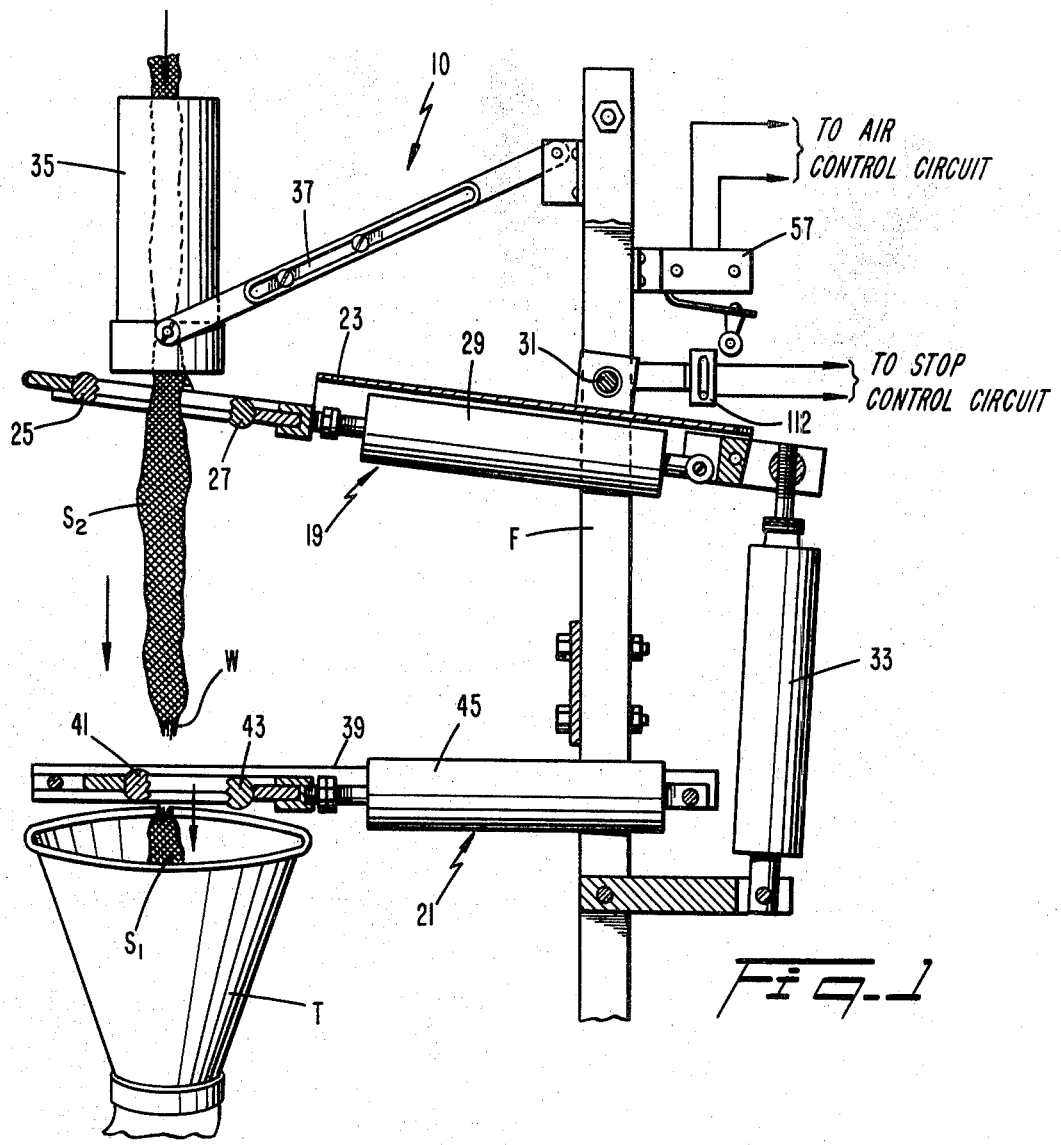
FIG. 1 is a side view of the separator assembly and illustrating the position wherein a hosiery article has just been separated.

Referring now to FIG. 1 in particular, there is illustrated a separation assembly 10 in a first position wherein a first in-line hosiery article $S_1$ is separated from a string of hosiery articles and a second in-line article $S_2$. The separator assembly may be mounted on a komet-type knitting machine having a frame F. The frame F is a part of the underside of the knitting machine table supporting a conventional knitting head and other knitting machine components (not shown). The first in-line hosiery article $S_1$ is being dropped into the opening of a transfer tube T, also supported by the frame of the machine. A gripping and separating means, denoted generally by reference numeral 19 is pivotally mounted on the frame F. Also, a clamping means, denoted generally at 21, is mounted to the frame downstream along the hosiery string of the gripping and separating means.

More specifically, the gripping and separating means 19 comprises an arm 23, a pair of gripping jaws 25, 27 mounted on the free end of the arm 23 and a pneumatic actuating cylinder 29 for intermittently opening and closing the gripping jaws 25, 27. The arm 23 is pivotally mounted to the frame F by pivot member 31. The means for moving the separator means, that is the gripping and separating arm 23, is provided by a pneumatic cylinder 33 operative to provide the pivoting action of the arm about the pivot member 31.

The separator means 10 also includes a guide member 35 for guiding the string of knitted articles $S_1, S_2 \ldots S_n$ through the gripping jaws 25, 27. The guide member is pivotally attached to the arm 23 and also includes a sliding linkage 37 to keep the center of guide member substantially vertical throughout the arcuate path of the arm 23.

The clamping means 21 comprises an arm 39, a pair of gripping jaws 41, 43 mounted on the end of arm 39, and an actuating cylinder 45 for intermittenly opening and closing the jaws. The arm 39 is fixedly attached to the frame F and serves to grip the first in-line hosiery article $S_1$ for the separation cycle (note FIG. 2).

Figure 6:
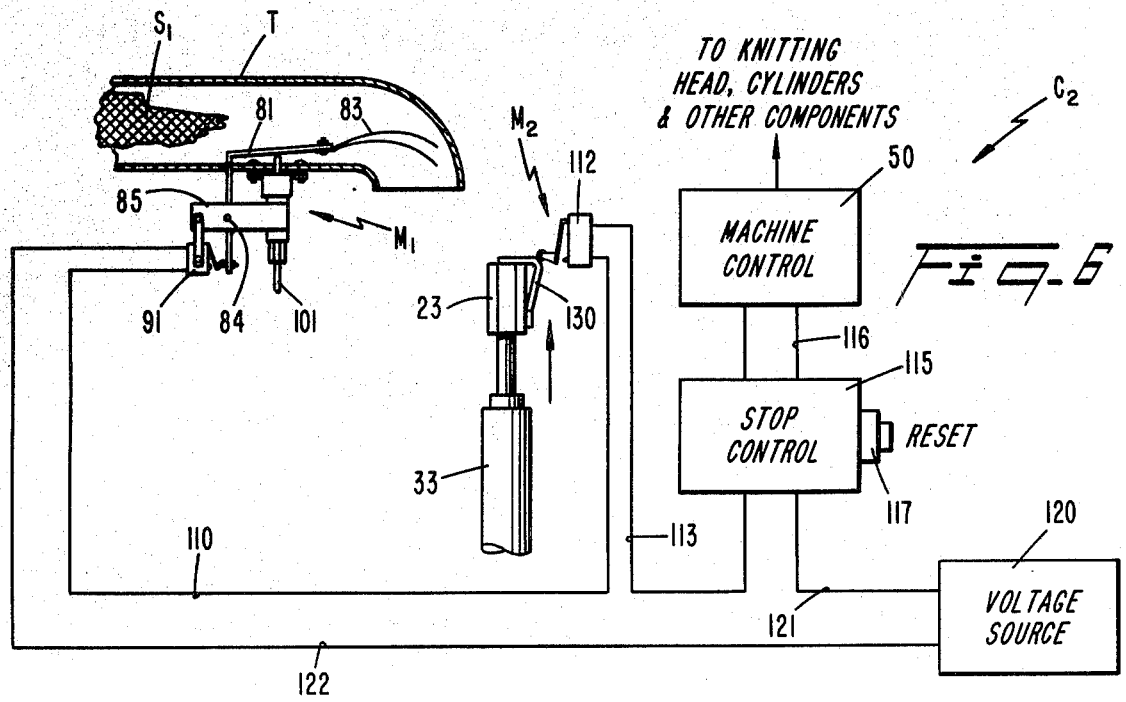
FIG. 6 is a schematic view of the interrupter control circuit and illustrating the positioning of the advance switch in relation to the hosiery article and the stop action switch in relation to the moving separator arm.

The actuating cylinders 29, 33, 45 are actuated by a source of compressed air (not shown) in response to the main machine control 50 (see FIG. 6).

Figure 2:
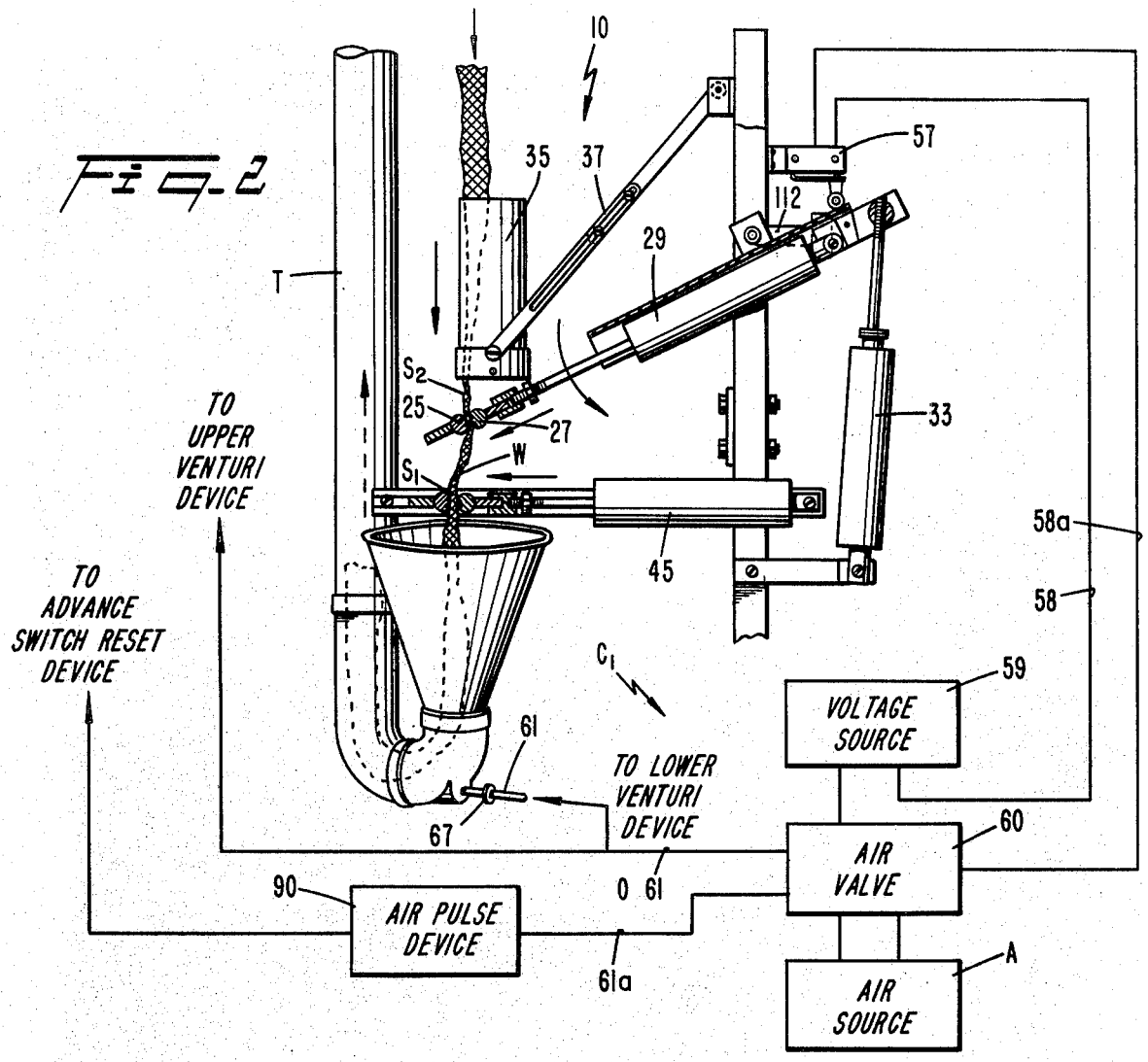
FIG. 2 is an expanded view of the separator assembly including a schematic view of the pneumatic transport and reset control circuit and with the separator in the ready position for separating a hosiery article.

With reference now to FIG. 2, a pneumatic transport and reset control circuit, generally designated by the reference indicia $C_1$, includes a separation cycle switch 57, positioned for actuation when the separator arm 23 is in the second or home position, ready to separate the hosiery articles $S_1$, $S_2$. The switch 57 is interconnected through lines 58, 58*a* to voltage source 59 and an air valve 60. The air valve feeds air output tubes 61, 61*a*. The tube 61 feeds a lower venturi device 67 (FIG. 2) as well as an upper venturi device 67*a* (FIG. 3) of the transfer tube T. The venturi devices 67, 67*a* provide suction along the tube T establishing the transfer path for the hosiery articles (note article $S_1$ in FIG. 3). The air valve 60 may be provided with a conventional air source A.

In operation of the separator apparatus 10 insofar as now described, the machine control 50 includes a suitable timing mechanism (not specifically shown) causing the jaws 25, 27 to close so as to engage the string of hose $S_2$ above a weakened portion W. Simultaneously with engagement of the jaws 25, 27, the machine control 50 causes the cylinder 45 of the arm 21 to close jaws 41, 43 so as to engage the first in-line article $S_1$ adjacent to and slightly below the weakened portion W. The machine control next initiates the activation of cylinder 33 moving the separator arm 29 upwardly to the position shown in FIG. 1. As the jaws 25, 27 pull the string $S_2$ upwardly, the weakened portion W is broken (FIG. 1) the article $S_1$ drops into the funnel end of the transfer tube T and the lower portion of the string $S_2$ drops down, all as the jaws 25, 27, 41, 43 are opened, also in response to the machine control 50.

Figure 3:
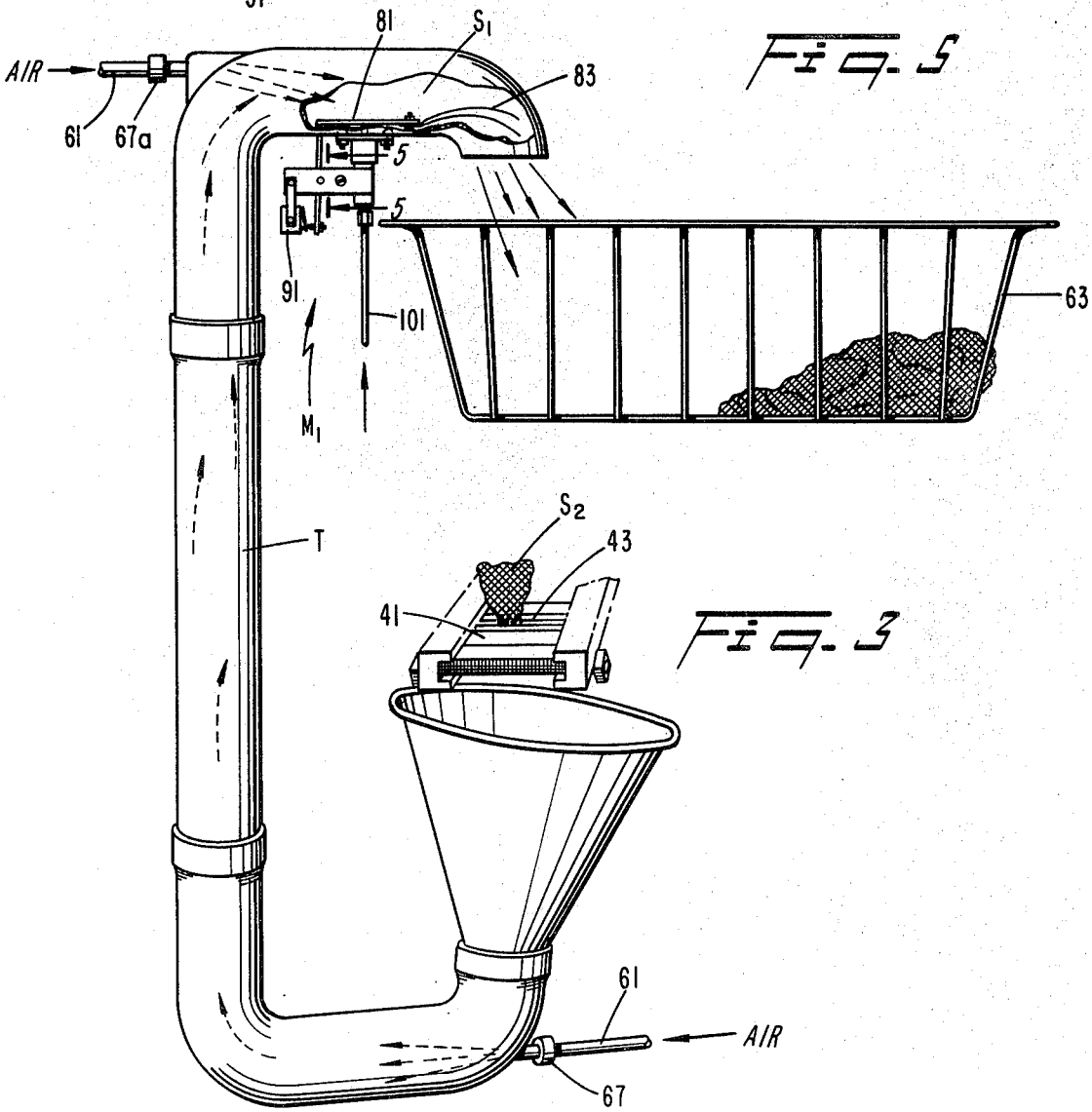
FIG. 3 is a side view of the transfer tube illustrating a hosiery article separated and transferred to a remote point.

The hosiery article $S_1$ travels up the tube T due to the vacuum generated by the venturi devices 67, 67a. As shown in FIG. 3, the article $S_1$ sweeps across an advance switch means, generally designated by the reference indicia $M_1$, positioned at a remote or discharge point along the transfer path. The articles $S_1$ are ejected from the mouth of the tube T into a collection basket 63, or the like. The hosiery articles received in the basket 63 may then be collected by the knitter, as desired. The separation cycle switch and the air valve 60 maintains the suction operating within the transfer tube T until the arm 29 returns to the second or home position (FIG. 2). For a more detailed description of the knitting machine and the separator assembly, reference is made to the prior U.S. Pat. No. 4,250,723, mentioned above, and incorporated herein by specific reference.

In accordance with one aspect of the present invention, a novel interrupter control circuit $C_2$ (see FIG. 6) is provided to control the separator apparatus 10 and the knitting machine itself in the event that a malfunction occurs during separation or transport of the articles $S_1$, $S_2$ . . . $S_n$. The circuit $C_2$ is characterized by its simplicity and its reliability to interrupt the knitting machine either in the event that the article $S_1$ fails to separate or is otherwise entrapped along the tube T and does not complete the advance along the tube T into the basket 63. The first significant component of the interrupter control circuit $C_2$ is the advance switch means $M_1$ positioned adjacent the outlet mouth of the tube T, as shown in FIGS. 3 and 6. The switch means $M_1$ includes an actuator arm 81 having outwardly extending spring fingers 83 on the distal end of the arm. The arm is pivotally mounted on pivot member 84 of support bracket 85.

A micro switch 91 is secured to the support bracket 85 by strap 93. The switch finger of the micro switch 91 engages the lower end of the actuator arm 81, as shown in FIG. 6. Switch 91 is normally closed, as indicated above, and during each cycle of operation if the switch remains in the position shown in FIG. 6, the machine control 50 is interrupted, as will be more clearly in detail below.

In order to properly open the micro switch 91, an article $S_1$ moves over the arm 81 and the spring fingers 83. When this is done, the feeler finger of the switch 91 is depressed and the switch 91 is opened.

The spring fingers 83 are positioned in the transfer path of the articles as best shown in FIG. 3. The fingers preferably have sufficient resiliency to trip the arm 81 as the article $S_1$ passes, but at the same time allows the passage of the article out of the mouth and into the basket 63.

In order to assure that the micro switch 91 is maintained in its proper open or closed position, a detent mechanism D is provided to hold the actuator arm 81 in either the actuated or reset position. The detent mechanism D includes a ball 95 urged by a spring 96 into a first recess 97 (reset position) and a recess 97a (lowered or actuated position). This assures that only the passage of an article $S_1$ can trip the actuator arm 81 and cause activation of the switch 91. The flow of air across the arm 81 caused by the suction device or any outside force on the machine cannot inadvertently trip the arm 81.

Figure 5A:
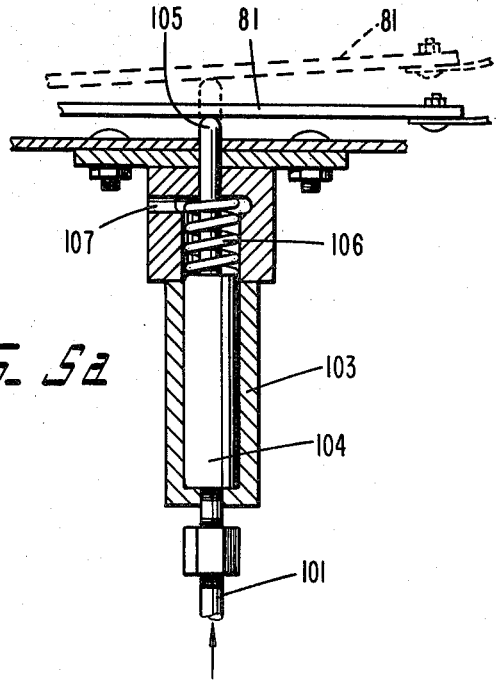
FIG. 5*a* is an enlarged cross-sectional view of the reset cylinder for the actuator arm.
Figure 4:
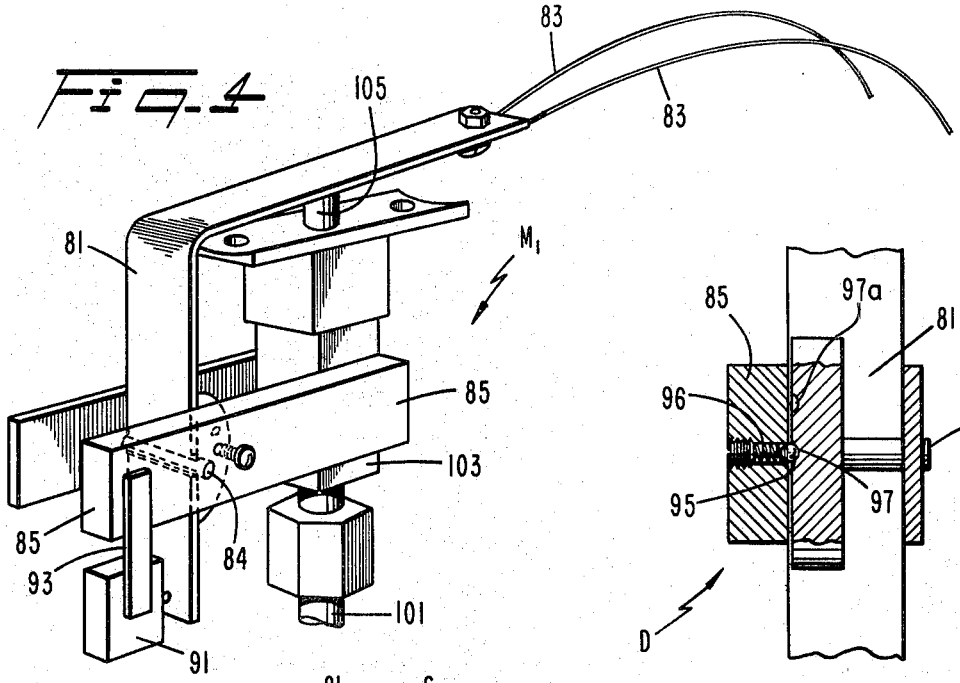
FIG. 4 is an enlarged perspective view of the advance switch means for detecting passage of the hosiery article at the remote point illustrated in FIG. 3.
Figure 5:
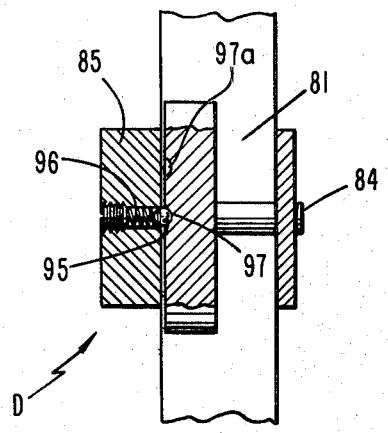
FIG. 5 is an enlarged cross-sectional view of the detent means of the advance switch means of FIG. 4.

In order to provide a reset function to the actuator arm 81, an air pulse device 90 is provided to receive air from the air valve 60 and transmit the pulse along the air conduit 101 to a reset cylinder 103 (see FIGS. 2, 4 and 5a). The cylinder 103 has a reset plunger 104 including a plunger rod 105 engaging the bottom of the actuator arm 81. When the arm is in the actuated or lowered position (full line position of FIG. 5a) the plunger 104 is positioned in the bottom of the cylinder 103. At the moment the separation cycle switch 57 is engaged and the air pulse is thereby provided through the conduit 101, the plunger 104 and plunger rod 105 are operative to lift the arm to the upper or dotted line position shown. A return spring 106 can be provided to release the plunger 104 after the pulse has terminated. An exhaust port 107 is provided to prevent trapping of air in the upper portion of the cylinder 103.

The air pulse device may be any conventional one-shot type pneumatic device that is common and available on the market. The air pulse device is timed so that the plunger 104 is activated and released before the separation of the article $S_1$ occurs. Specifically, the plunger 104 is activated after arm 23 is raised from the position of FIG. 2 to the position of FIG. 1, thereby precluding a false stop as cam 130 again engages switch 112. This assures that the actuator arm 81 is free to be lowered into the activated position as the article $S_1$ approaches the position of exit into the basket 63 as shown in FIG. 3.

Moving on now to a fuller description of the interrupter control circuit illustrated in FIG. 6 of the drawings, the advance switch means $M_1$ is connected in series with stop action switch means $M_2$. The connection is made in series through the line 110. The switch means $M_2$ includes a normally open micro switch 112 connected in series through line 113 with a stop control mechanism 115. The stop control mechanism may include any conventional mechanism of the type having a one-shot amplifier providing an acknowledgment signal, which in case of the present invention indicates a malfunction, and is fed directly to the machine control 50 over line 116. When the interrupt acknowledgment signal is received by the machine control 50, the knitting machine, including the knitting head and separator cylinders 29, 33 and 45 are deactivated, along with all the remaining components of the knitting machine. After the knitter has removed the entrapped article $S_1$, or corrected any other part of the machine that is malfunctioned, a reset button 117 may be pushed to allow restarting of the knitting machine. The circuit $C_2$ is completed by the voltage source 120 connected through line 121 to the stop control device 115 and through line 122 to the advance switch means $M_1$.

The stop action micro switch 112 is advantageously activated in the apparatus of the present invention by a cam 130 mounted on the side of the separator arm 23 (see FIG. 6). In operation, as the arm 23 moves from the first position of FIG. 1 to the second position or home position of FIG. 2, the cam 130 moves the normally open switch to the closed position. The sweeping action of the cam 130 past the switch 112 can be seen by viewing the showing of FIG. 1. Since the micro switch 112 is in series with the micro switch 91 if a hosiery article $S_1$ does not arrive at the proper remote position, thereby leaving the switch 91 in the closed position, the circuit will be made as the cam 130 closes switch 112 thereby activating the stop control means 115. Of course, if the micro switch 91 of the advance switch means $M_1$ has been opened by passage of the article $S_1$ before the arm 23 with the cam 130 moves upwardly toward the second position, the circuit is opened and the stop control 115 is not activated.

By virtue of the above described inventive concepts, it can be seen that a reliable stop action or interrupter control is provided to prevent damage to a knitting machine when a malfunction occurs in the knitting or separating operations. That is, when a hosiery article $S_1$ fails to be transported from the separator assembly 10 to the remote location at the advance switch means $M_1$, the stop control 115 is then activated and the machine control 50 is interrupted. Thus by incorporation of two simple switch means, the knitting machine is protected. The simplicity and reliability of the interrupter apparatus of the present invention provides considerable improvement over the existing systems.

The preceeding specification describes preferred embodiment of the invention as an illustration and not a limitation of the invention. It is appreciated that equivalent variations and modifications of the invention will occur to those skilled in the art. Such modifications, variations and equivalents are within the scope of the invention as recited with greater particularity in the appended claims, when interpreted to obtain the benefits of all equivalents to which the invention is fairly and legally entitled.

We claim:

1. In a knitting machine having a separator for separating a tubular string into individual articles and an interrupter apparatus for said machine comprising separator means operable to grasp an article for separation from the string, means for moving said separator means to effect the separating operation, means to transfer said articles after separation and defining a transfer path from the point of separation to a remote point, an interrupter control circuit, stop action switch means in said circuit responsive to the movement of said separator means between first and second operable positions, advance switch means in said circuit positioned along the transfer path of articles for actuation in response to detection of an article being advanced to said remote point, said advance switch means including a microswitch and a pivotal actuator arm for said microswitch, said actuator arm being positioned along said transfer path and detent means for holding said arm in a tripped position when engaged by an article and a reset position, and further including reset means for positioning said arm in the reset position in readiness for the next article along said path, said reset means including a reset control circuit and cycle switch means responsive to the movement of said separator means to said second operable position prior to each separation cycle, and stop control means in said circuit for stopping the knitting machine operation only in response to both said stop action and advance means, whereby the machine is stopped only when said articles fail to be properly separated and advanced along said transfer path.

2. The interrupter apparatus according to claim 1 wherein said reset means further includes a plunger mounted in a cylinder, a plunger rod in engagement with the actuator arm for resetting said arm, and said reset control circuit including air power means responsive to said cycle switch means for actuation of said plunger and resetting of said arm.

3. The interrupter apparatus according to claim 1 wherein is provided spring fingers attached to the end of said arm positioned in said transfer path, said fingers having sufficient resiliency to trip said arm and allow passage of said article.

4. The interrupter apparatus according to claim 1 wherein said separator means comprises a pivotal separator arm and said moving means includes a pneumatic cylinder responsive to the machine control for said knitting machine.

5. The interrupter apparatus according to claim 4 wherein is provided gripper jaws on said arm to grasp said string to effect the separation upon movement of said separator arm, and a second pneumatic cylinder for actuating said gripper jaws.

6. The interrupter apparatus according to claim 2 wherein said air power means includes an air valve responsive to said cycle switch means, and an air pulse device responsive to said air valve to actuate said plunger.

7. The interrupter apparatus according to claim 6 wherein said transfer means include a tube defining said transfer path and a venturi device in said tube for providing suction along said tube and responsive to said air valve.

8. The interrupter apparatus according to claim 1 wherein said interrupter circuit further comprises a voltage source, said stop action and said advance switch means being in series with said voltage source and said stop control means, whereby the machine is interrupted only upon closing of both switches.

9. The interrupter apparatus according to claim 8 wherein is further provided cycle switch means responsive to the movement of said separator means to said second operable position prior to each separation cycle, said stop action switch being positioned for actuation by said separator means before actuation of said cycle switch means, whereby said machine is interrupted before the next cycle can be initiated if the advance switch means is not activated by the passage of said article.

* * * * *